US010201209B2

(12) United States Patent
Obie

(10) Patent No.: US 10,201,209 B2
(45) Date of Patent: Feb. 12, 2019

(54) MIRACLE HEEL

(71) Applicant: Edna Obie, Houston, TX (US)

(72) Inventor: Edna Obie, Houston, TX (US)

( * ) Notice: Subject to any disclaimer, the term of this patent is extended or adjusted under 35 U.S.C. 154(b) by 61 days.

(21) Appl. No.: 13/647,209

(22) Filed: Oct. 8, 2012

(65) Prior Publication Data

US 2014/0096412 A1 Apr. 10, 2014

(51) Int. Cl.

| | |
|---|---|
| ***A43B 3/24*** | (2006.01) |
| ***A43B 1/10*** | (2006.01) |
| ***A43B 13/00*** | (2006.01) |
| ***A43B 21/40*** | (2006.01) |
| ***A43B 21/42*** | (2006.01) |

(52) U.S. Cl.

CPC ..... *A43B 3/24* (2013.01); *A43B 3/246* (2013.01); *A43B 21/40* (2013.01); *A43B 21/42* (2013.01)

(58) Field of Classification Search

CPC ..... A43B 13/34; A43B 13/36; A43B 13/30; A43B 13/37; A43B 21/47; A43B 21/48

USPC ..... 36/100, 101, 103, 104, 105, 42

See application file for complete search history.

(56) References Cited

U.S. PATENT DOCUMENTS

| | | | | | |
|---|---|---|---|---|---|
| 1,156,769 | A * | 10/1915 | Fortin | 36/36 R | |
| 1,674,549 | A * | 6/1928 | Hobert | 36/36 R | |
| 1,743,543 | A * | 1/1930 | Gutierrez | 36/42 | |
| 1,831,268 | A * | 11/1931 | Starks | 36/36 R | |
| 1,888,617 | A * | 11/1932 | Bridi | A43B 21/39 | 36/42 |
| 1,926,818 | A * | 9/1933 | Rateliff | 36/58.5 | |
| 1,972,223 | A * | 9/1934 | Hassel | 36/36 R | |
| 2,431,868 | A * | 12/1947 | Gilmour | 36/42 | |
| 2,795,866 | A * | 6/1957 | Perugia | 36/24.5 | |
| 2,943,404 | A * | 7/1960 | Sultan | 36/42 | |
| 3,318,025 | A * | 5/1967 | Barriga | A43B 13/28 | 36/30 R |
| 3,538,628 | A * | 11/1970 | Einstein, Jr. | 36/15 | |
| 4,610,100 | A * | 9/1986 | Rhodes | A43B 21/39 | 36/36 A |
| 5,058,290 | A * | 10/1991 | Koehl et al. | 36/42 | |
| 5,357,697 | A * | 10/1994 | Lin | 36/137 | |
| 5,953,836 | A * | 9/1999 | Watt | A43B 3/24 | 36/100 |
| 6,442,870 | B1 * | 9/2002 | Tsai | 36/11.5 | |
| D732,281 | S * | 6/2015 | Morris Thill | D2/946 | |
| 2004/0000076 | A1 * | 1/2004 | Celmo | A43B 7/1465 | 36/141 |
| 2006/0053661 | A1 * | 3/2006 | van Duyne | A43B 3/24 | 36/100 |
| 2007/0011909 | A1 * | 1/2007 | Palmeri, III | 36/42 | |

* cited by examiner

*Primary Examiner* — Timothy K Trieu

(74) *Attorney, Agent, or Firm* — Delphine James

(57) ABSTRACT

A convertible shoe may include a lightly padded and flexible sole to facilitate a comfortable fit and steady footing and a removable heel. A new shoe having removable heels for permitting a user to wear a single pair of shoes which can be used in high heel form and in a flat form is disclosed. The new shoe device includes a sole having opposite heel and toe ends. The device further includes a disjoined heel removable from the heel of the sole. The heel includes a slot that extends linearly the length of the heel. The heel of the sole includes a recessed portions that extends the length of the sole that is removable engaged therewith.

12 Claims, 6 Drawing Sheets

MIRACLE HEEL

BACKGROUND OF THE INVENTION

Technical Field

This patent claims the benefit of provisional patent

This invention relates to shoes and, more particularly, to a convertible shoe for providing users with an easy and convenient means of instantly converting a pair of stilettos into a pair of flats and vice versa.

Countless fashion conscious consumers depend on stylish high heel shoes as a means of accentuating their wardrobe. From strappy sandals and spiked stilettos to the extremely popular pump, many women prefer fashion over function, wearing shoes that may look attractive, yet nonetheless play havoc on their feet. As can be imagined, putting one's feet through endless hours of abuse and then complaining when they are tired, swollen and sore is not the most comfortable way to spend a day. Simply stated, wearing high heel shoes can be completely taxing on the foot. Most high heel shoes are manufactured to be sleek and sexy and therefore completely lack the padding and shock absorption needed to properly cushion the foot.

Providing little support, wearing a pair of high heels for even a few hours can result in extreme discomfort and pain. Why do women so willingly put themselves through such torture? Perhaps it is because wearing high heel shoes is a simple way in which to extend the calve muscles, making the leg look shapely and lean. Additionally, high heel shoes also serve to add a few inches to the wearer's height. Allowing even those shorter individuals to appear statuesque, a pair of high heel shoes can simultaneously be a woman's best friend and worst enemy. Not surprisingly, because high heels can be so painful, many women remove their shoes, walking barefoot to their car or home after the end of a long day on heels. Unfortunately, walking barefoot across a parking lot, or even a crowded dance floor not only results in the feet becoming filthy dirty, but can also render one exposed to gravel, broken glass and even the careless feet of others, all of which can cause pain and injury to already aching feet.

Accordingly, a need remains for an apparatus in order to overcome the above-noted shortcomings. The present invention satisfies such a need by providing a convertible shoe that is convenient and easy to use, lightweight yet durable in design, versatile in its applications, and designed for instantly converting a pair of stilettos into a pair of flats and vice versa.

BRIEF DESCRIPTION OF THE SEVERAL VIEWS OF THE DRAWING

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
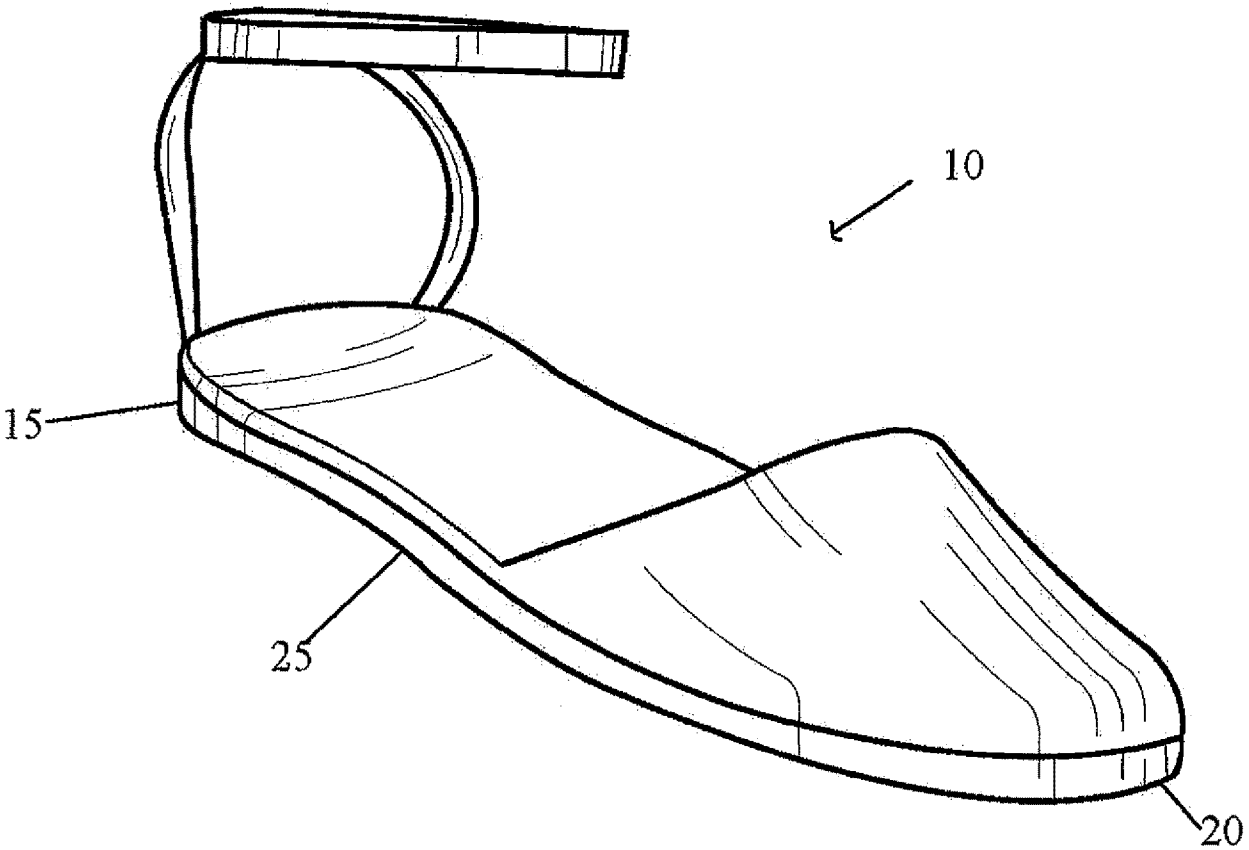
FIG. 1 is a perspective view of a new shoe with the heel removed heel according to the present invention.
Figure 2:
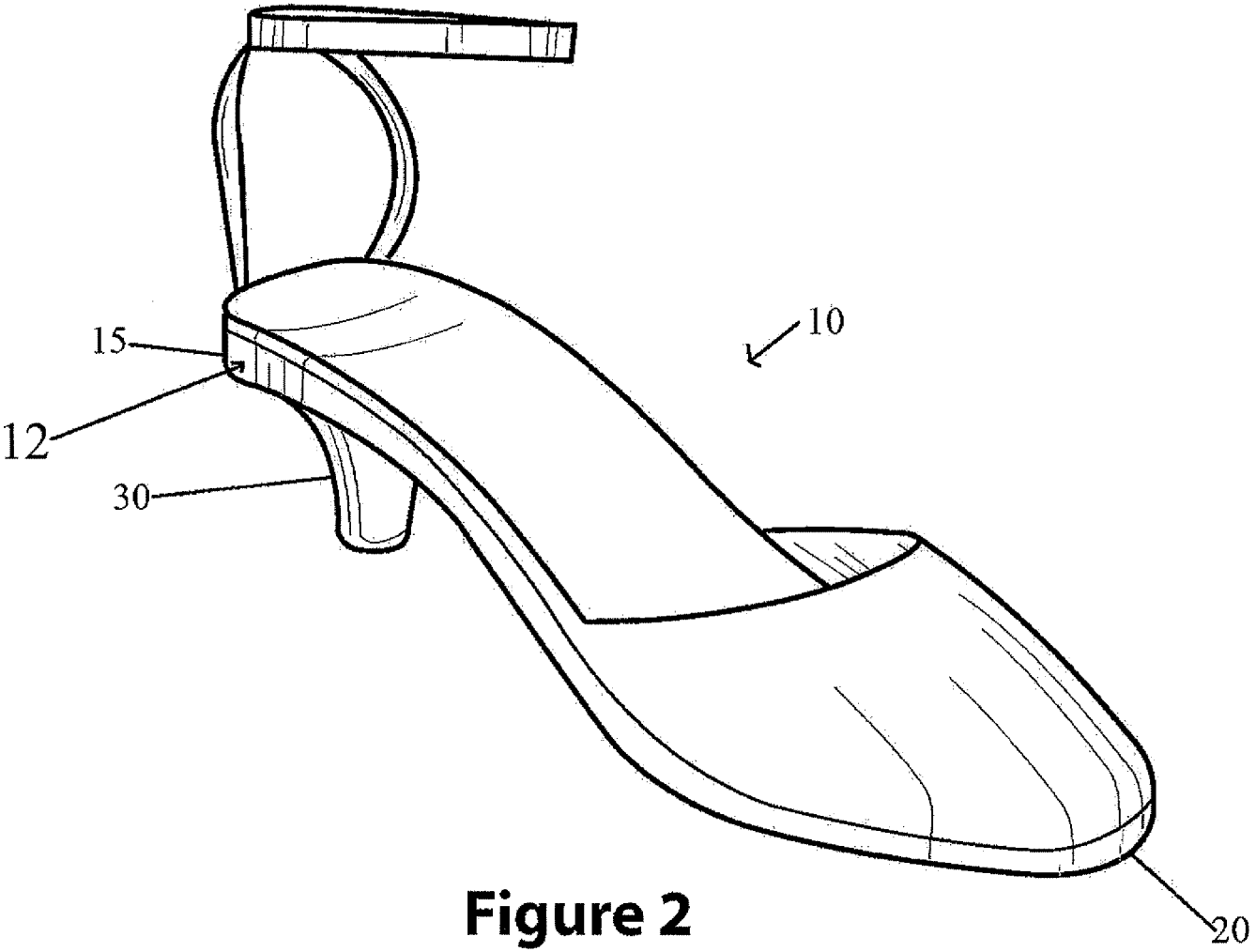
FIG. 2 is a perspective view of a new shoe with the removable heel attached according to the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The apparatus of this invention is referred to generally in the figures and is intended to provide a convertible shoe. It should be understood that the present invention may be used in converting a pair of stilettos into a pair of flats instantly and vice versa, and should not be limited to the uses described herein.

Referring to the FIGS. 1-4 in general, in a non-limiting exemplary embodiment, the convertible shoe 10 may include a lightly padded and flexible sole 20 to facilitate a comfortable fit and steady footing and a removable heel 30. Produced in a variety of heights, the heel 30 may include a sliding and interlocking fitting 32 positioned on the top of the heel 30 and designed to accommodate a recessed female threaded fitting 37 located at the sole 15 of the shoe 10. Other interlocking mechanisms can be utilized to interlock the disjoined heel 30 to sole of shoe 10. As such, the heel 30 may easily slid into place on the underside of the shoe 37, locking in place and then easily released and removed after use. The heel 30 may be manufactured from a variety of materials included heavy duty acrylic, polished wood and leather. The apparatus 10 may further be produced in a wide variety of styles from canvas mules, to open toe and strappy sandals, to stylish pumps. As with traditional shoes, the apparatus 10 may be produced in a variety of sizes and colors.

FIGS. 1-5 illustrates, the convertible shoe (10) of the present invention. The convertible shoe (10) of the present invention comprises a sole (12) having a lower surface with an opposite heel (15) and toe ends (20), and a pair of sides (25) extending between the heel (15) and toe ends (20) of the sole (15). The heel (15) of the sole (12) of the have a recessed portion (37) extending a pre-determined length thereon forming a channel (37) thereon. In the preferred embodiment, the channel (37) extends the length of the heel (15) of the sole (12).

The convertible shoe (10) of the present invention further comprises the disjoined heel (30) having an upper surface with spline (32) raised above the upper surface extending the length of the channel (37). The spline (32) configured to securely engaged into the channel (37) wherein the heel ( ) is securely attached to the heel (15) lower surface of the sole (12).

The shoe (10) of the present invention further comprises a first track of attaching elements (33) disposed adjacent and parallel to the spline (32) and a first track of mating elements (43) disposed adjacent and parallel to the channel (37) configured to securely engage with the first track of attaching elements (33) wherein the heel (15) of the sole (12) is securely attached to the disjoined heel (30).

The shoe of the present invention further comprises a second track of attaching elements (34) disposed adjacent and parallel to the spline (32) opposite the first track of attaching elements (33) and on the opposite side of the spline (32).

Figure 5:
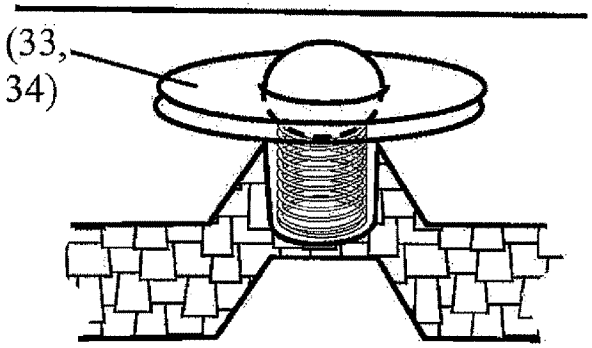
FIG. 5 is a cut away view of the fastener mechanism extended.
Figure 5A:
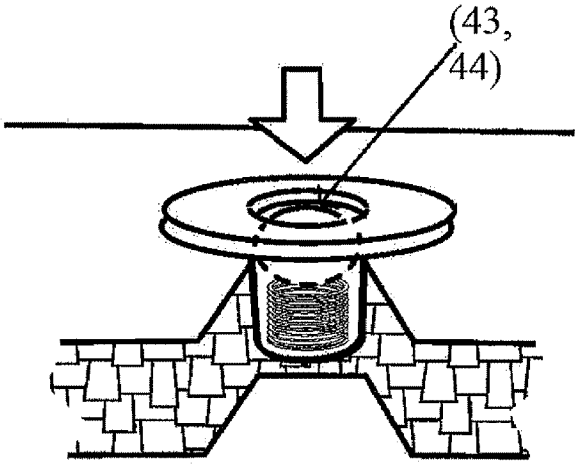
FIG. 5*a* is a cut away view of the fastener retracted.
Figure 5B:
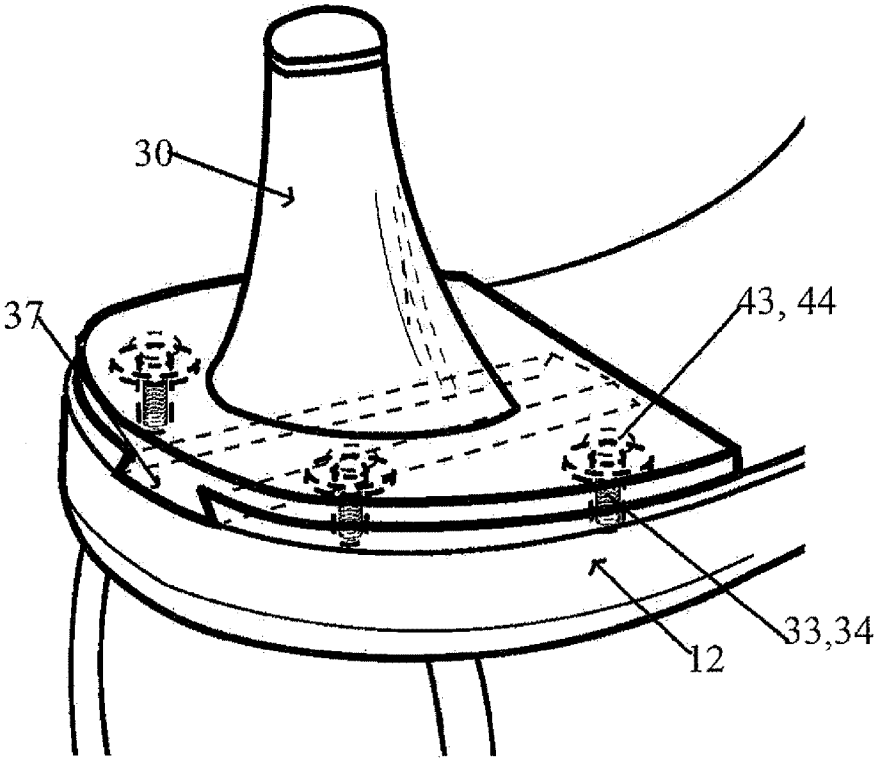
FIG. 5*b* is a schematic top view of the heel of the present invention with the fasteners.

A second track of mating elements (44) is disposed adjacent and parallel to the channel (37) opposite the first track of mating elements (43) wherein the second track of mating elements (44) is configured to securely engage with the first track of attaching elements (33) wherein the heel (15) of the sole (12) is securely attached to the disjoined heel (30). In the illustrated embodiment depicted in FIGS. 5, 5*a*, and 5*b*, the first and second track of attaching elements (33, 34) are spring loaded ball bearings and the first and second track mating elements (43, 44) are apertures.

Figure 3:
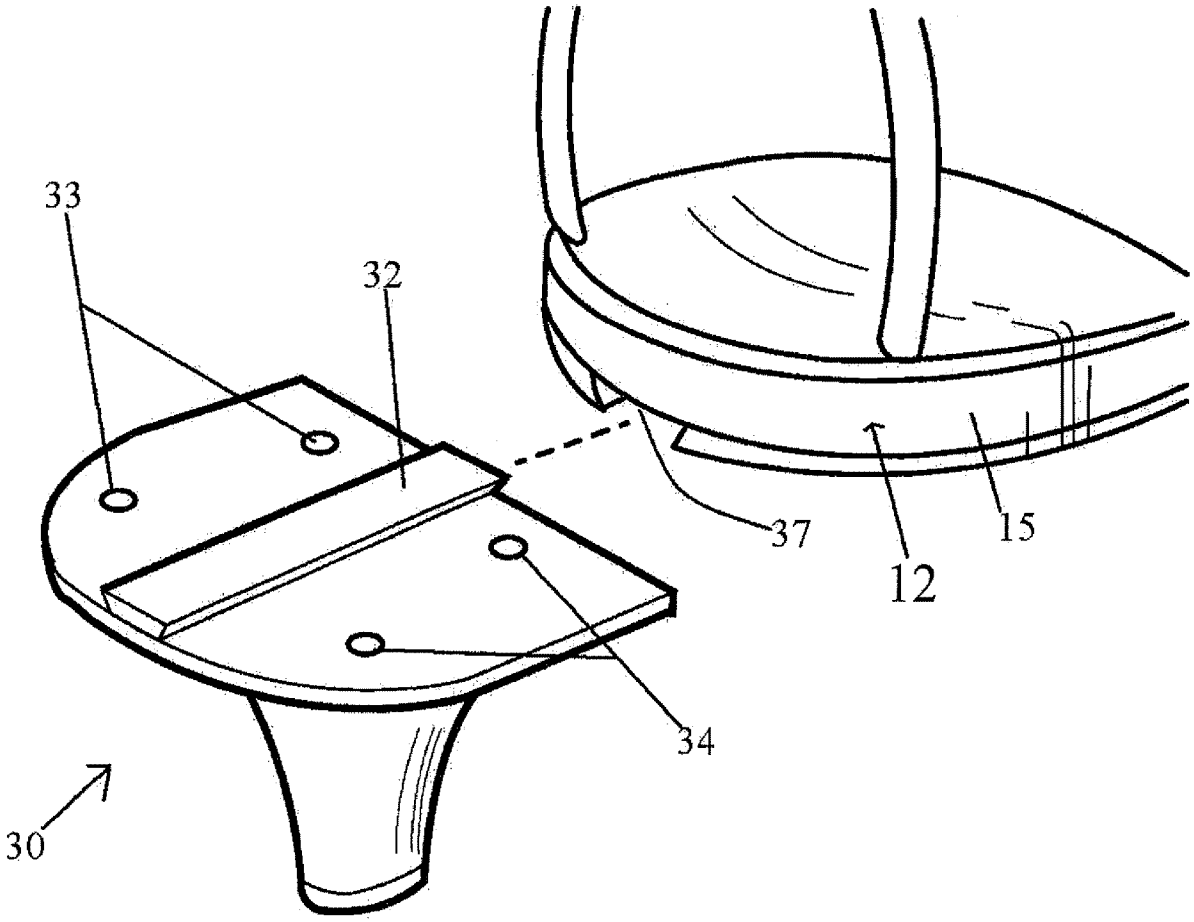
FIG. 3 is a schematic exploded heel end side view of the present invention.
Figures 3A, 3B, 3C:
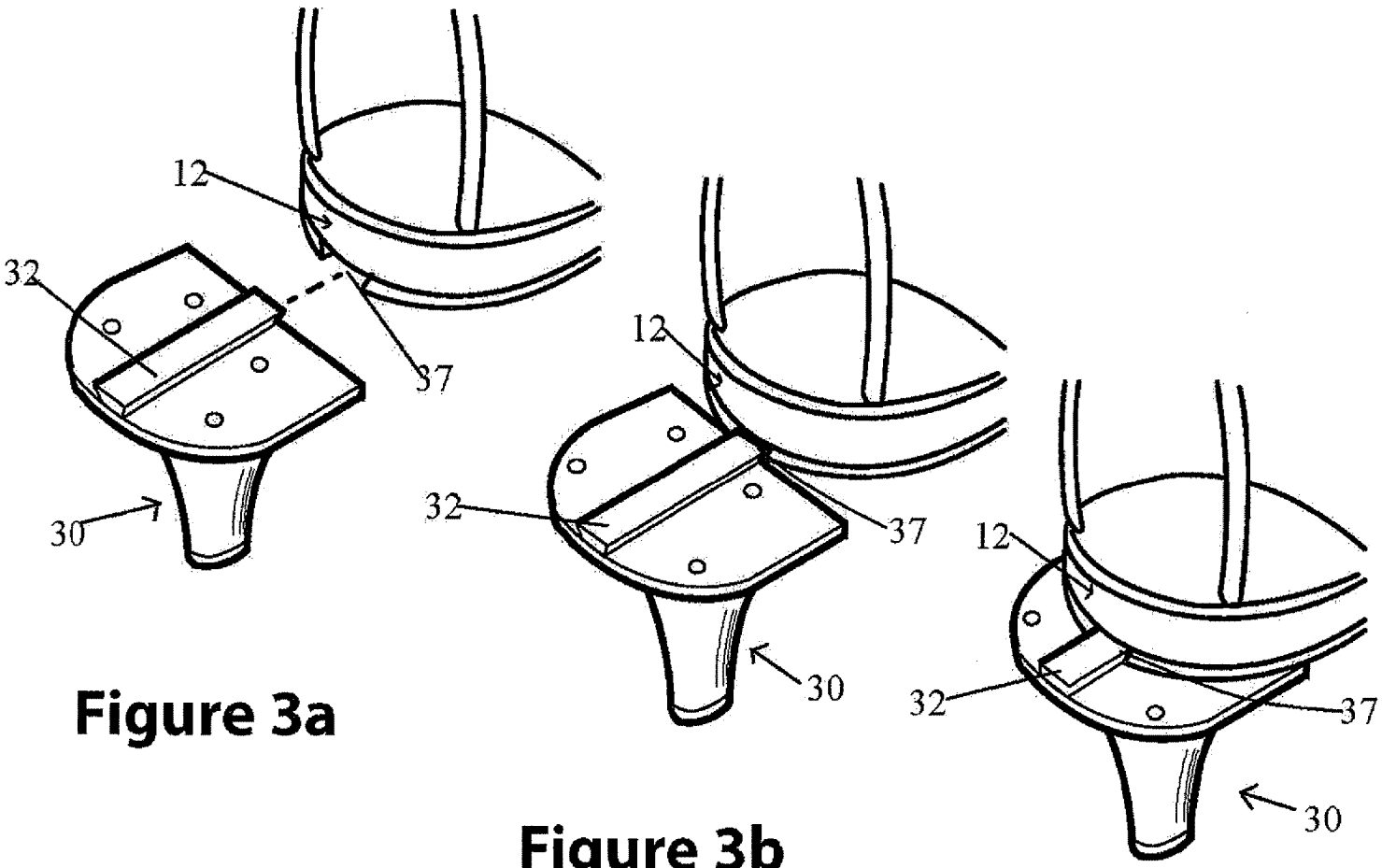
FIG. 3*a* is a schematic exploded heel end side view of the present invention with the heel detached.
FIG. 3*b* is a schematic exploded heel end side view of the present invention with heel initially engaged.
FIG. 3*c* is a schematic exploded heel end side view of the present invention with the heel inserted.
Figure 4:
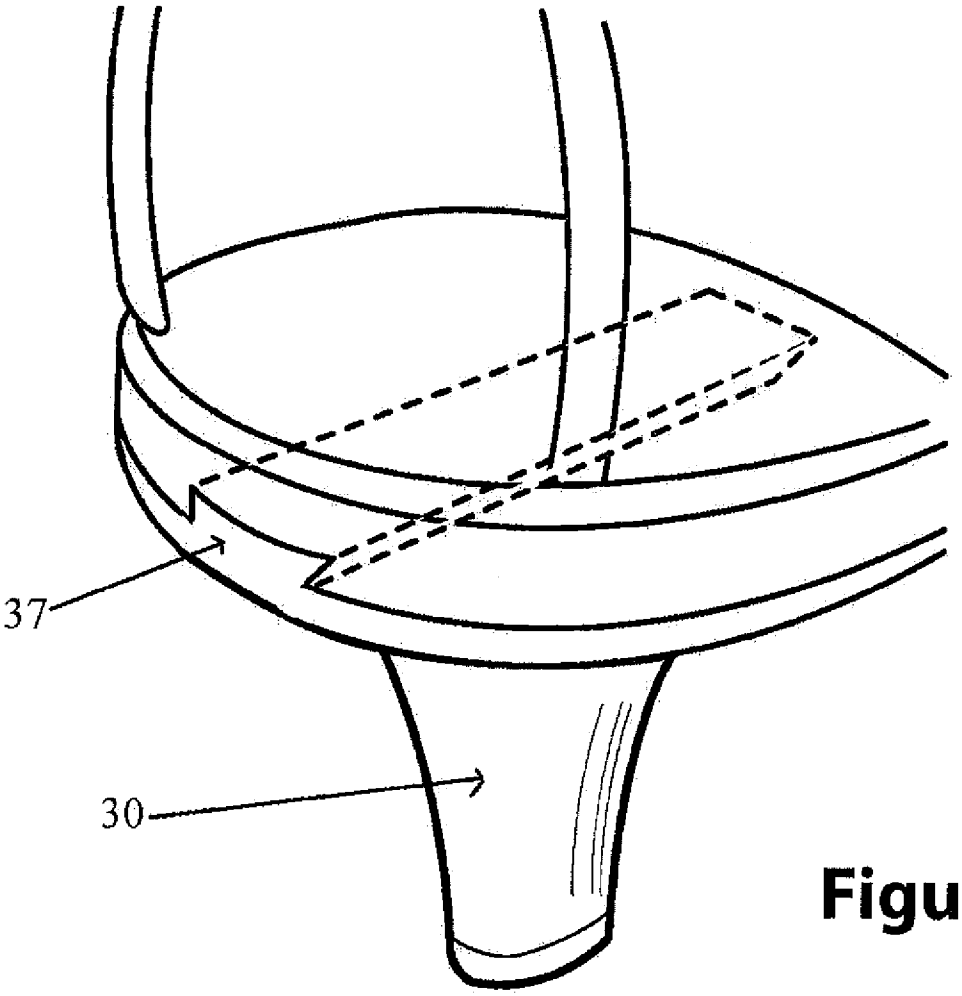
FIG. 4 is a schematic bottom side view of the sole of the present invention.

In use ad depicted in FIGS. 3*a, b*, and *c*, as the spline of the disjoined heel (30) is slid into recessed portion (37), the spring loaded ball bearings is depressed and then released into the apertures (43, 44) securing the attaching elements (33, 34) in place. Other fastening mechanisms can be utilized. Additionally, the attaching elements and the mating elements can be reversed wherein attaching elements are adjacent to the channel and the mating elements are adjacent to the spline. In use the connection between the attaching elements and the mating elements provides an equal distribution of the weight of the user alleviating the stress upon the spline (32) interlocking connection.

In a non-limiting exemplary embodiment, a handy storage pouch may be included for use in easily storing the heels 30 in a purse or tote. Lightweight and portable, the heel 30 may be easily stored in the handy carrying pouch when not in use. The handy pouch may easily fit in any clutch, purse or attaché, providing effortless access whenever needed.

There are several significant benefits and advantages associated with the convertible shoe 10. As a non-limiting example, the apparatus 10 in FIG. 1-4 may provide female users customizable footwear which may enable them to enjoy the striking fashion of high heel shoes, while also providing an instant reprieve for sore feet at the end of a long day or evening's festivities. Stylish stilettos boasting detachable heels, such footwear may provide females cushiony relief after long hours spent on their feet. A practical alternative to traversing a crowded dance floor or gravel parking lot with bare feet, the apparatus 10 may offer females a remarkably effective barrier between the foot and the hard ground surface area. Eliminating the sore, achy feet associated with wearing high heels, the apparatus 10 may provide soothing relief after a day's festivities. Attractive in design, such comfortable footwear may add a striking touch to any ensemble.

In use, the convertible shoe 10 would be simple and straightforward to use. First the user would purchase a pair of apparatus 10 in accordance to size and style. Sliding the heel attachment to the bottom of each sole 15 as shown in FIGS. 3*a, b*, and *c* allowing the user to transform the flats illustrated in FIG. 1 into a pair of heeled shoes illustrated in FIG. 2 for a night on the town with friends. At the end of the evening, the user would once again remove the heels from the bottom of her shoes, tossing the heels into their carrying pouch and dropping them into a purse or glove compartment for use when again needed.

There has thus been outlined, rather broadly, the more important features of the invention in order that the detailed description thereof that follows may be better understood, and in order that the present contribution to the art may be better appreciated.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

While the invention has been described with respect to certain specific embodiments, it will be appreciated that many modifications and changes may be made by those skilled in the art without departing from the spirit of the invention. It is intended, therefore, by the description hereinabove to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed is:

1. A convertible shoe, comprising: an outer sole having a lower surface defined by a toe portion, a rear portion, and a pair of opposing sides that attaching the toe portion to said rear portion;

the rear portion forwardly extends and merges into a mid portion; the rear portion has a larger depth than the midportion; the rear portion forming a heel configured to contact the ground;

a channel formed by a recessed portion that longitudinally extends proximately near a midpoint along a length of the heel therein; a disjoined heel having an upper surface;

a spline raised above an upper surface corresponding to the length and the recess of the channel;

wherein the channel having a first adjacent edge aligned parallel to an opposite second adjacent edge;

wherein the spline having a first corresponding adjacent edge aligned parallel to an opposite corresponding adjacent edge;

wherein the spline configured to operatively engage within the channel aligning the first adjacent edge directly above abutting and configured to interlock with the first corresponding adjacent edge and the opposite second adjacent edge directly above abutting and configured to interlock with the opposite corresponding adjacent edge; and wherein the heel having a flat outer surface that is configured to contact the ground when not engaged with the disjoined heel;

furthermore, comprising a first track of a plurality of spaced apart-mating elements linearly aligned and operationally mounted along the first adjacent edge of the channel;

a first track of a plurality of spaced apart attaching elements linearly aligned and operationally mounted along the first corresponding adjacent edge of the spline;

wherein the attaching elements engages with the mating elements to secure the disjoined heel to the heel;

a second track of the plurality of spaced apart-mating elements linearly aligned and operationally mounted along the opposite second corresponding adjacent edge;

a second track of the plurality of spaced apart attaching elements linearly aligned and operationally mounted along the opposite corresponding adjacent edge; wherein the second track of the attaching elements engages with the second track of the mating elements to secure the disjoined heel to the heel.

2. The shoe of claim 1 wherein each of the plurality of the mating elements is an aperture with a connector member operationally mounted therein.

3. The shoe of claim 2 wherein each of the plurality of the mating attaching elements is a spring ball bearing mechanism operationally configured to engage with the respective connector member when the spline of the disjoined heel is engaged with the channel of the heel.

4. The shoe of claim 1 wherein the channel extends the length of the heel.

5. The shoe of claim 1 further comprising a container surrounded by sidewall with an internal chamber having an internal cavity large enough for carrying a plurality of disjoined heels.

6. The shoe of claim 1 wherein the spline and the channel have an equivalent corresponding trapezoidal geometric structure.

7. The shoe of claim 1 wherein the first adjacent edge extends the length of the channel.

8. The shoe of claim 1 wherein the opposite second adjacent edge extends the length of the channel.

9. The shoe of claim 1 wherein the first corresponding adjacent edge extends the length of the spline.

10. The shoe of claim 1 wherein the opposite corresponding adjacent edge extends the length of the spline.

11. The shoe of claim 1 wherein the disjoined heel is a silhouette heel.

12. A convertible shoe, compromising: a sole having a lower surface with a heel and a toe ends, and a pair of sides extending between the heel and toe ends of the sole; the heel end of the sole having a recessed portion forming a channel extending a length of the heel end; a disjoined heel having an upper surface with a spline raised above the upper surface extending the length of the heel end; and the spline configured to securely engaged into the channel; wherein the disjoined heel is securely attached to the lower surface of the sole; furthermore, a first track of attaching elements disposed adjacent and parallel to the spline; and a first track of mating elements disposed adjacent and parallel to the channel configured to securely engage with the first track of attaching elements that where the sole is securely attached to the disjoined heel;

a second track of the attaching elements disposed adjacent and parallel to the spline opposite the first track of attaching movable elements; and a second track of mating elements disposed adjacent and parallel to the channel opposite the first track of mating elements; wherein the second track of attaching elements is configured to securely engage with the first track of attaching elements that where the sole is securely attached to the disjoined heel.

* * * * *